US006796827B1

(12) United States Patent
Chen

(10) Patent No.: US 6,796,827 B1
(45) Date of Patent: Sep. 28, 2004

(54) QUICK CONNECTOR FOR POWER CORD

(76) Inventor: Chia-Teh Chen, 5Fl., No. 30, Yi Shian Rd., Sung Shan Chu, Taipei (TW)

( * ) Notice: Subject to any disclaimer, the term of this patent is extended or adjusted under 35 U.S.C. 154(b) by 0 days.

(21) Appl. No.: 10/751,224

(22) Filed: Jan. 2, 2004

(51) Int. Cl.[7] ..... H01R 13/62
(52) U.S. Cl. ..... 439/348; 362/226; 362/406
(58) Field of Search ..... 439/336, 348, 439/537; 362/226, 457, 406

(56) References Cited

U.S. PATENT DOCUMENTS 4,956,756 A * 9/1990 Hsiao ..... 362/226
5,702,264 A * 12/1997 Endo et al. ..... 439/348
6,322,232 B1 * 11/2001 Oliver ..... 362/226
6,517,223 B2 * 2/2003 Hsu ..... 362/405
6,648,488 B1 * 11/2003 Pearce ..... 362/226
6,676,442 B2 * 1/2004 Kerr, Jr. ..... 439/537
6,682,303 B2 * 1/2004 Wu ..... 362/226

* cited by examiner

*Primary Examiner*—Gary Paumen
*Assistant Examiner*—Briggitte R. Hammond
(74) *Attorney, Agent, or Firm*—Charles E. Baxley

(57) ABSTRACT

A quick connector for power wire can be easy assembled and disassembled, wherein a distribution box is interiorly provided with female base, the female base is provided with rolling needle, loop and sliding piece, so as to fit a male base provided on an end of power wire of electrical appliance. Such that the female base in the distribution box can be easily connected to the power wire of the appliance just by hand, the quick connector for power wire also can be firmly positioned and can prevent linkage. The rolling needle in the female base of the present invention is able to firmly position the male base, so as to prevent electrical linkage.

4 Claims, 8 Drawing Sheets

QUICK CONNECTOR FOR POWER CORD

BACKGROUND OF THE INVENTION

1. Field of the Invention

The present invention relates to a quick connector applied to power supply and power input end of electrical appliance, and more particularly to a quick connector which can be quick assembled and dismantled and easily positioned.

2. Description of the Prior Arts

For conventional electrical distribution structure, the power wire of power supply is normally fixed to appliances, and some household appliances are directly fixed to the distribution box (such as ceiling fan, ceiling light). This connecting method has been widely used for long period, however, there are still some defects need to be improved:

First, the assembly or disassembly of the ceiling fan, the ceiling light and the likes are not easy, especially the power wires are difficult to be disconnected or connected, which requires professional skills.

Second, since the appliances are directly fixed to the distribution box, the worker has to seal the exposed and re-connected power wires with insulating tape after the appliances are disassembled or repaired. However, the connection of the re-connected power wires are not firm and steady, the insulating tape will become loose and cause linkage.

The present invention has arisen to mitigate and/or obviate the afore-described disadvantages of the conventional connector for power wire.

SUMMARY OF THE INVENTION

The primary object of the present invention is to provide a quick connector for power wire, which can be easy assembled and disassembled, wherein a distribution box is interiorly provided with female base, the female base is provided with rolling needle, loop and sliding piece, so as to fit a male base provided on an end of power wire of electrical appliance. Such that the female base in the distribution box can be easily connected to the power wire of the appliance just by hand.

The secondary object of the present invention is to provide a quick connector for power wire which is firmly positioned and can prevent linkage. The rolling needle in the female base of the present invention is able to firmly position the male base, so as to prevent electrical linkage.

The present invention will become more obvious from the following description when taken in connection with the accompanying drawings, which shows, for purpose of illustrations only, the preferred embodiments in accordance with the present invention.

DETAILED DESCRIPTION OF THE PREFERRED EMBODIMENTS

Figure 1:
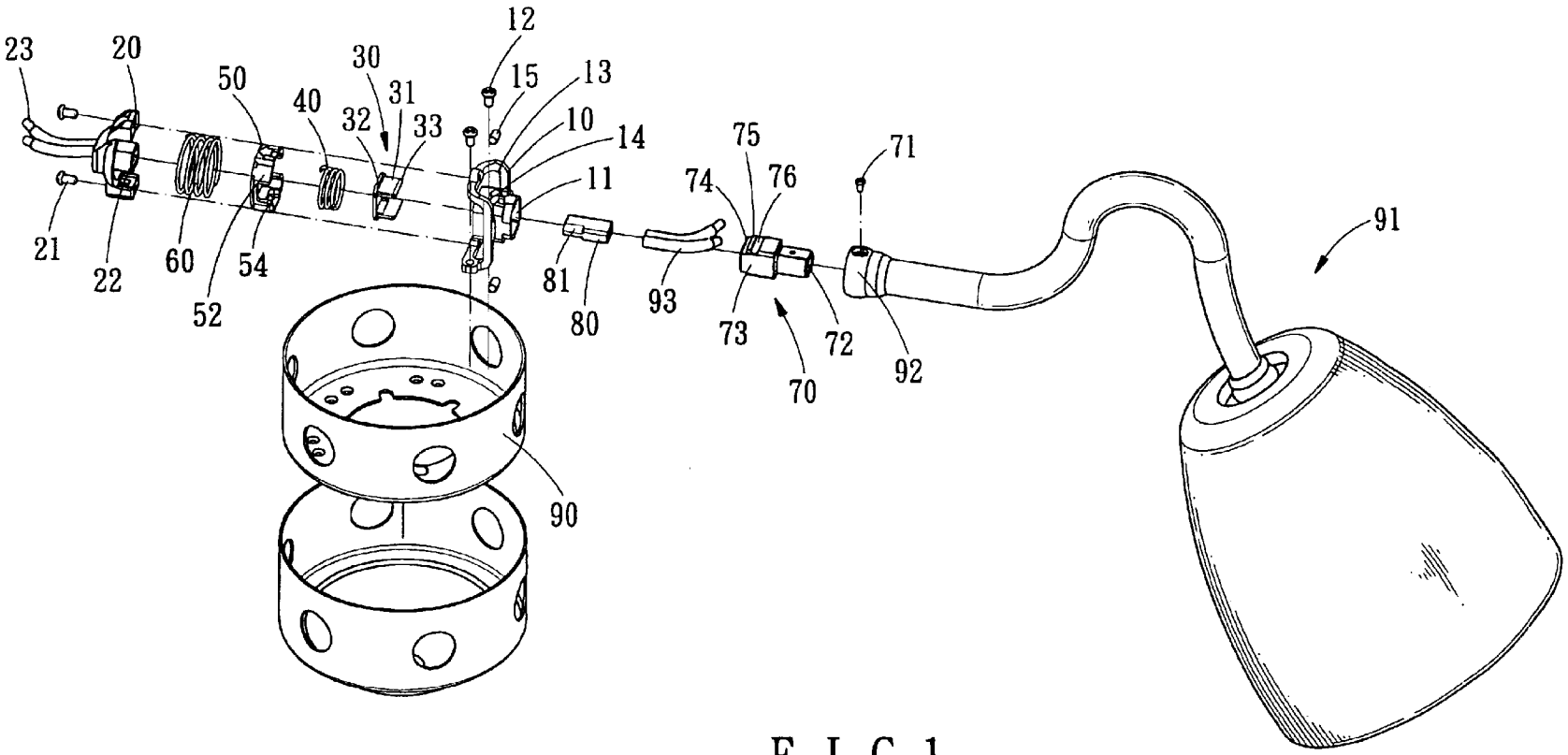
FIG. 1 is an exploded view of a quick connector for power wire in accordance with the present invention.
Figure 2:
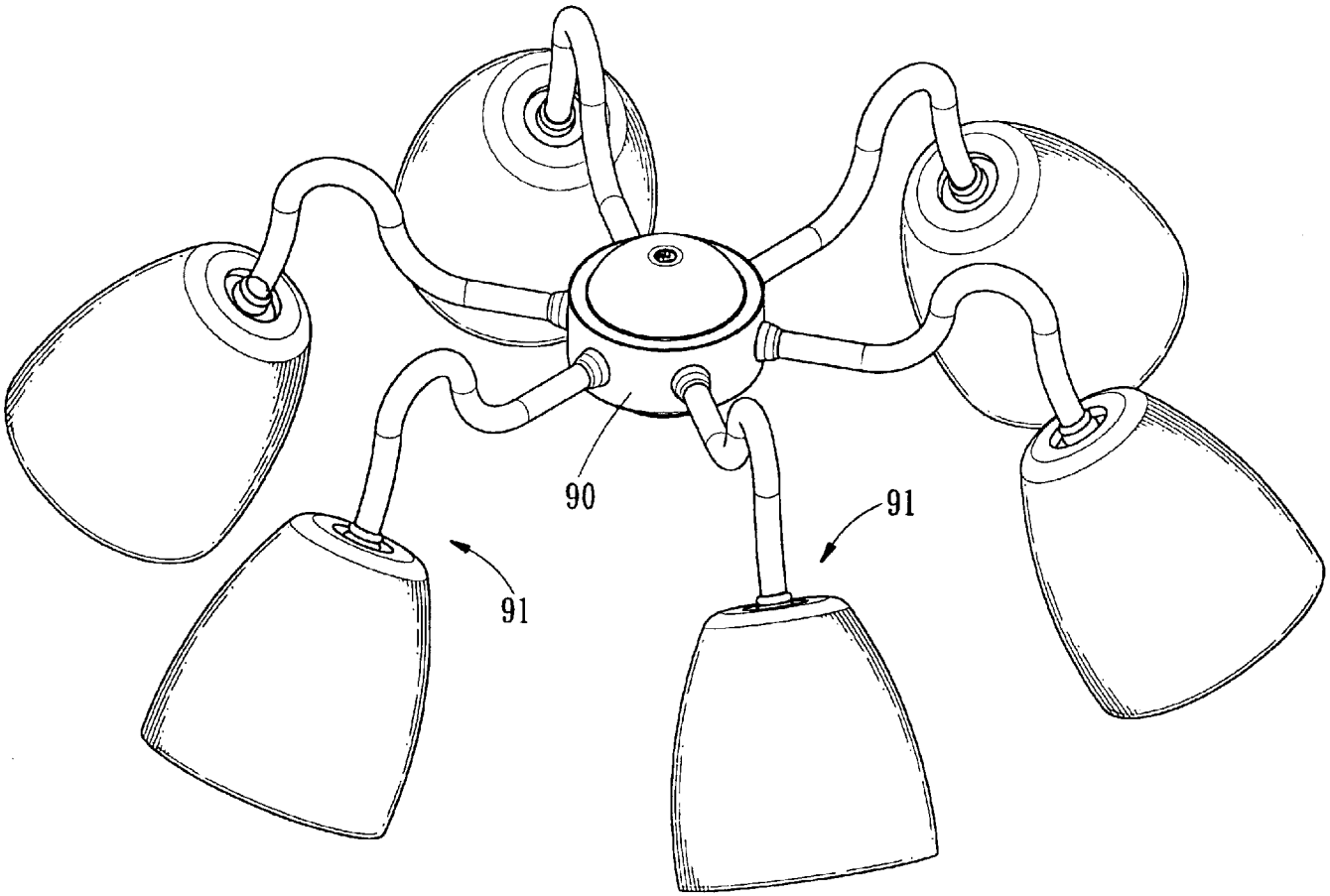
FIG. 2 is a perspective view of a ceiling light equipped with the quick connector for power wire in accordance with the present invention.
Figure 6:
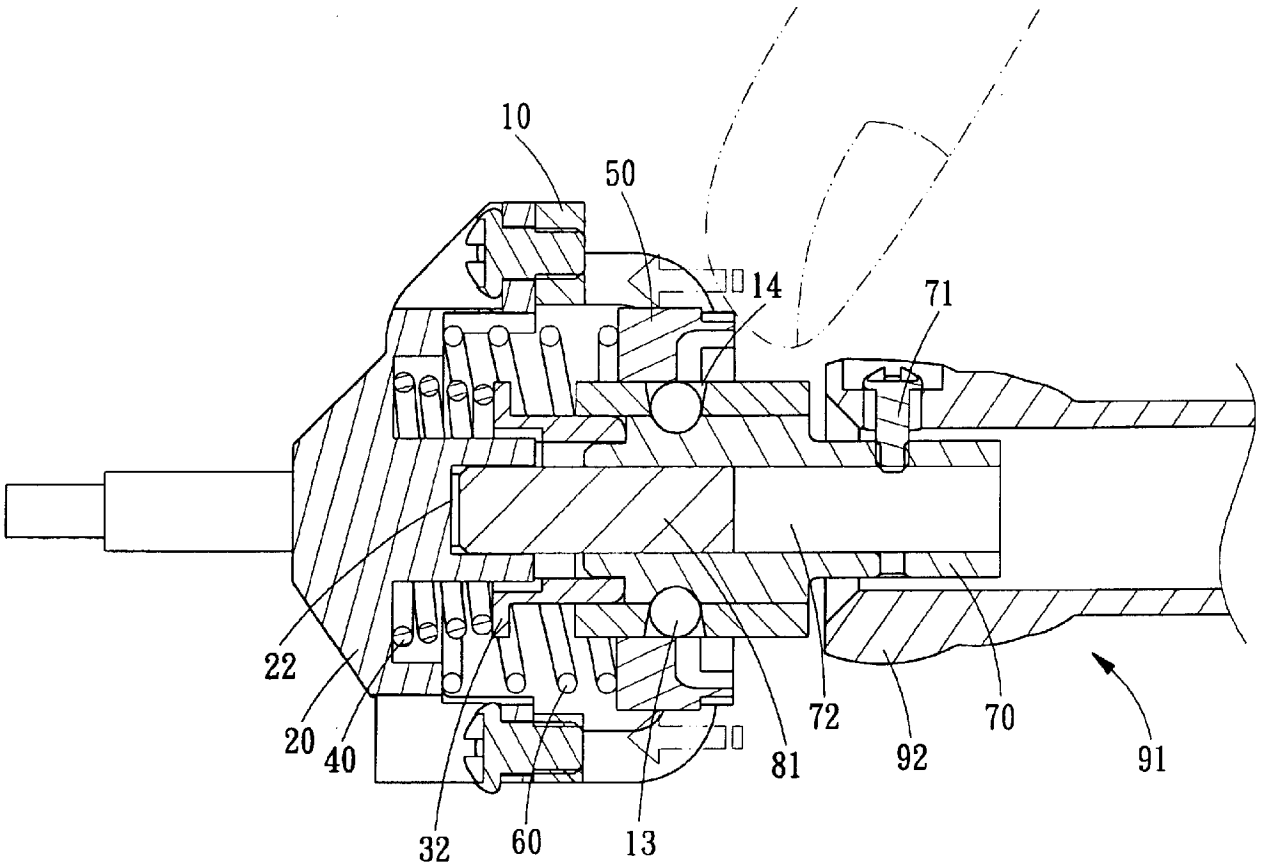
FIG. 6 is another cross sectional assembly view of a quick connector for power wire in accordance with an embodiment of the present invention, is being assembled.
Figure 7:
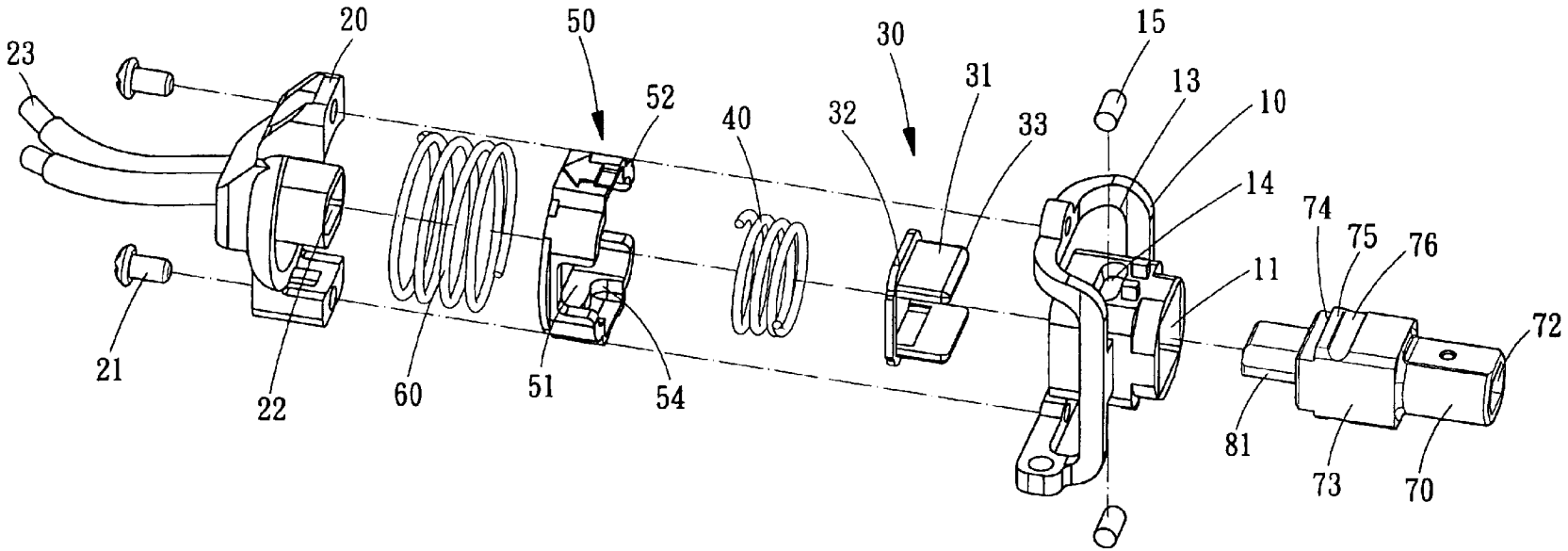
FIG. 7 is a partial exploded view of a quick connector for power wire in accordance with an embodiment of the present invention, is being assembled.

Referring to FIGS. 2, 6 and 7, wherein a quick connector for power wire in accordance with a first embodiment of the present invention is shown and generally comprised of a female base 10, a female cover 20, a sliding piece 30, an inner spring 40, a loop 50, an outer spring 60, a male base 70 and a male cover 80. The quick connector is disposed between a distribution box 90 and an object to be connected (electric appliance). The to-be-connected object is a ceiling light as example.

The female base 10, interiorly defined with a passage 11, is fixed in the distribution box 90 with screws 12, at both sides of the portions above and below the passage 11 formed with sliding holes 13, at the position corresponding to the sliding holes 13 are respectively formed with two through holes 14 by extending outward from the passage 11. In the through holes 14 are disposed with rolling needle 15 (or can be general rolling element: such as rolling balls, pin rollers and so on), the passage 11 is a through passage.

The female cover 20 is screwed on the female base 10 with screws 21, a connecting portion 22 is formed in the female cover 20 and employed to connect power wire 23.

The sliding piece 30 consists of two protrusive pieces 31 and a ring portion 32. In the front end of the two protrusive pieces 31 is formed with cambered surfaces 33, whereas the sliding piece 30 is movably disposed between the female base 10 and the female cover 20, and the two protrusive pieces 31 are inserted in the passage 11 of the female base 10 in a manner that the two protrusive pieces 31 abut against the inner surface of the passage 11. The traveling path of the two protrusive pieces 31 corresponds to the through holes 14 of the passage 11.

The inner spring 40 is biased between the ring portion 32 of the sliding piece 30 and the female cover 20.

The loop 50 is defined in the center with a through hole 51 and at both sides of which formed with protrusions 52. The through hole 51 serves to receive the inner spring 40 and the sliding piece 30. The protrusions 52 are to be slidably inserted in the sliding holes 13 of the female base 10, at outside of an inner surface of the protrusions 52 a cambered surface 53 and a receiving notch 54 are sequentially formed. The cambered surface 53 and the receiving notch 54 correspond to the through holes 14 of the female base 10, and the receiving notch 54 serves for the reception of the rolling needle 15.

The outer spring 60 is biased between the loop 50 and the female cover 20 for the reception of the inner spring 40.

The male base 70 is fixed to connecting end 92 of the ceiling light 91, while the power wire 93 of the ceiling light 91 connects the male base 70 in engaging hole 72. On the male base 70 corresponding to the end of the ceiling light 91 is defined with working portion 73 which is shaped in corresponding to the passage 11 of the female base 10. From the end of the working portion 73 inward a cambered edge 74, a flange 75 and a locating groove 76 are formed sequentially. The cambered edge 74 and the locating groove 76 correspond to the rolling needle 15 of the female base 10, whereas the flange 75 corresponds to the two protrusive pieces 31 of the sliding piece 30.

The male cover 80, at an end of which defined with an inserting portion 81 that forms in corresponding to the shape of the connecting portion 22 of the female cover 20. The male cover 80 is received in the engaging hole 72 of the male base 70, such that the power can be transmitted to the power wire 93 of the ceiling light 91 from the female cover 20.

Figure 3:
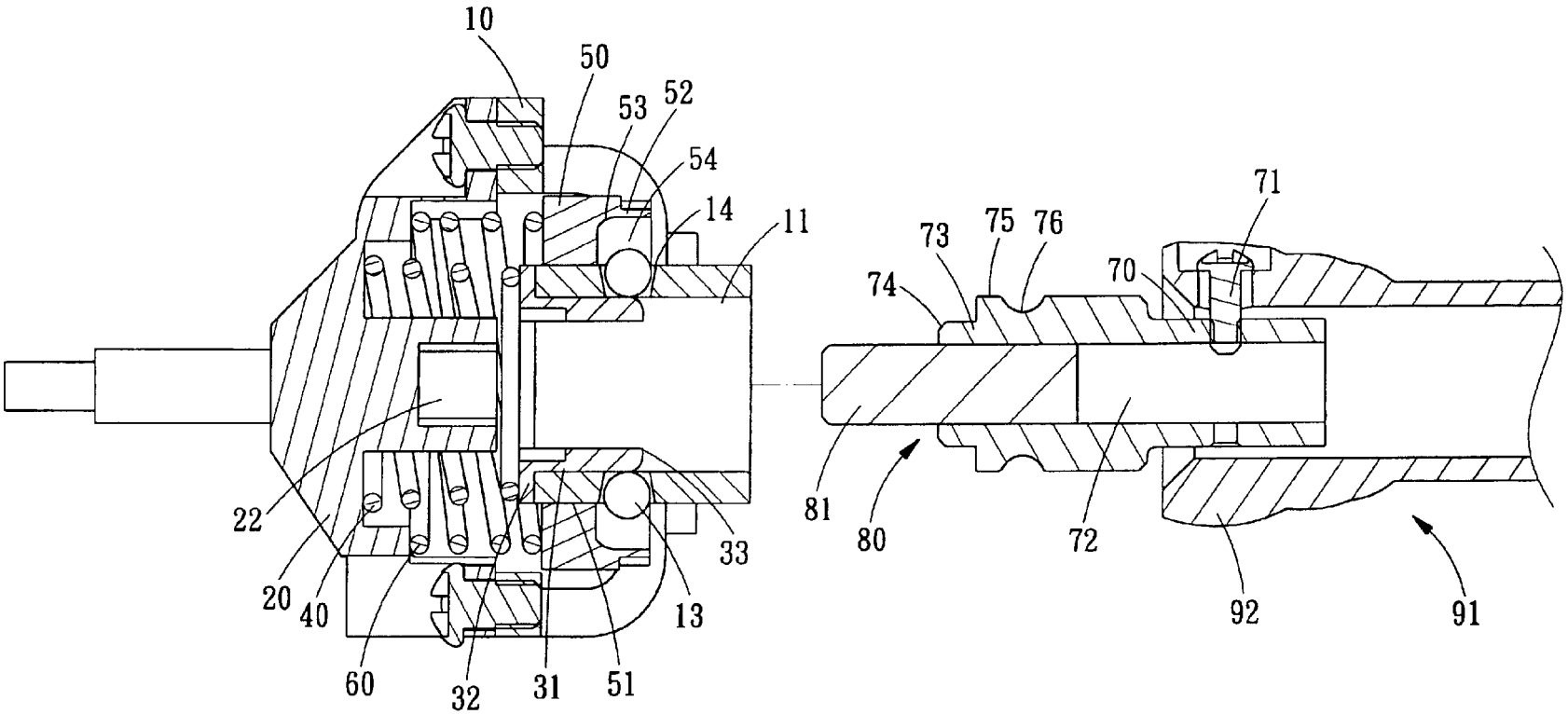
FIG. 3 is a cross sectional view of a quick connector for power wire, prior to assembly, in accordance with an embodiment of the present invention.

Referring further to FIGS. 3–6. In FIG. 3, before the ceiling light 91 is fixed to the distribution box 90, since the inner spring 40 pushes the sliding piece 30 to move forward, the two protrusive pieces 31 will insert into the passage 11 of the female base 10, whereas the cambered surface 33 of the protrusive pieces 31 push the rolling needle 15 in the through hole 14 of the passage 11 to move outward (into the receiving groove 54 of the loop 50). At this moment, the loop 50 is being pushed by the outer spring 60, however, the rolling needle 15 stops the protrusions 52 of the loop 50, in this case, the loop 50 can restore an elastic force at a predetermined position. Furthermore, the protrusive pieces 31 fully close up the hole 14 of the passage 11.

Figure 4:
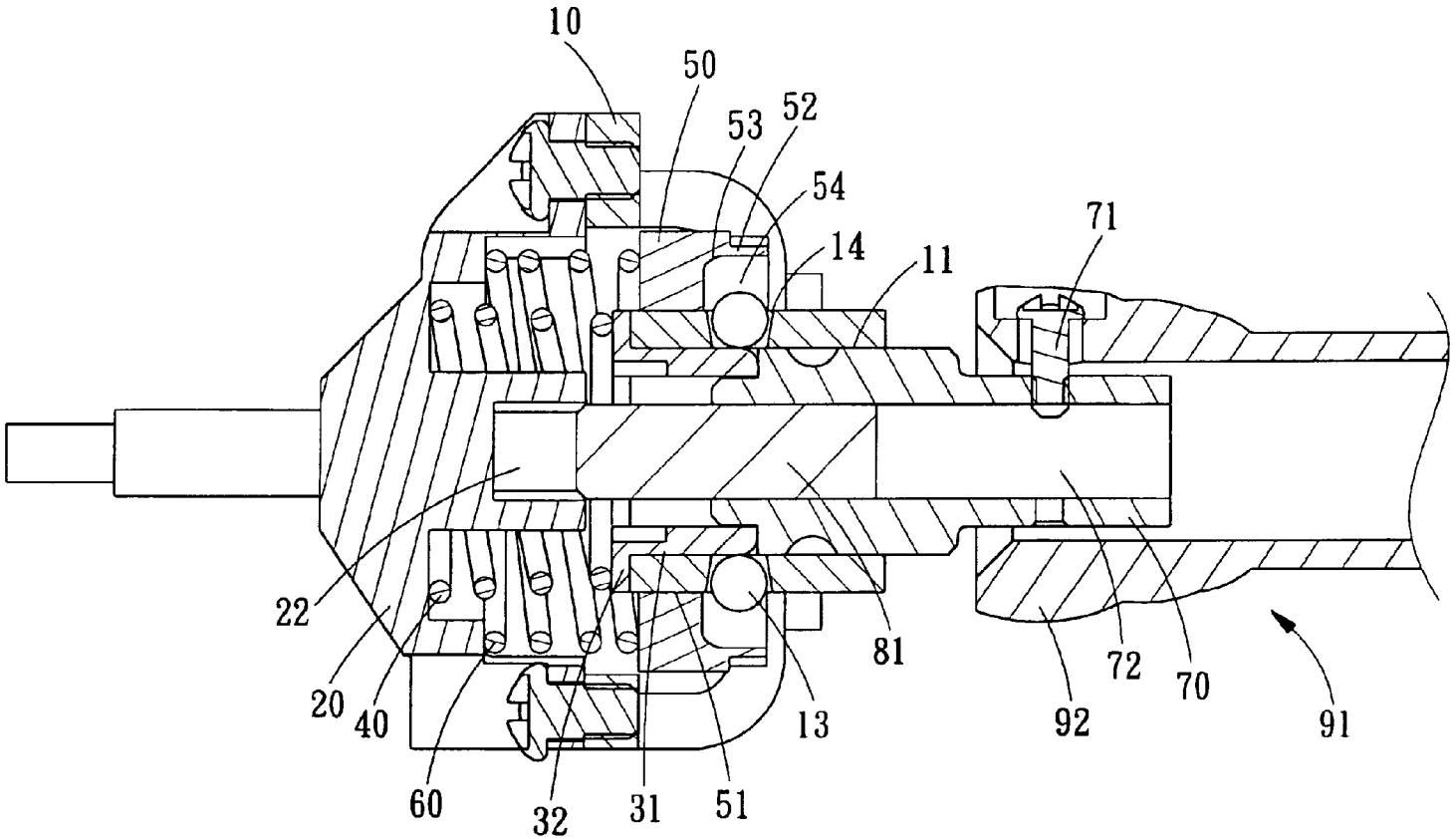
FIG. 4 is a cross sectional view of showing a quick connector for power wire, in accordance with an embodiment of the present invention, is being assembled.
Figure 5:
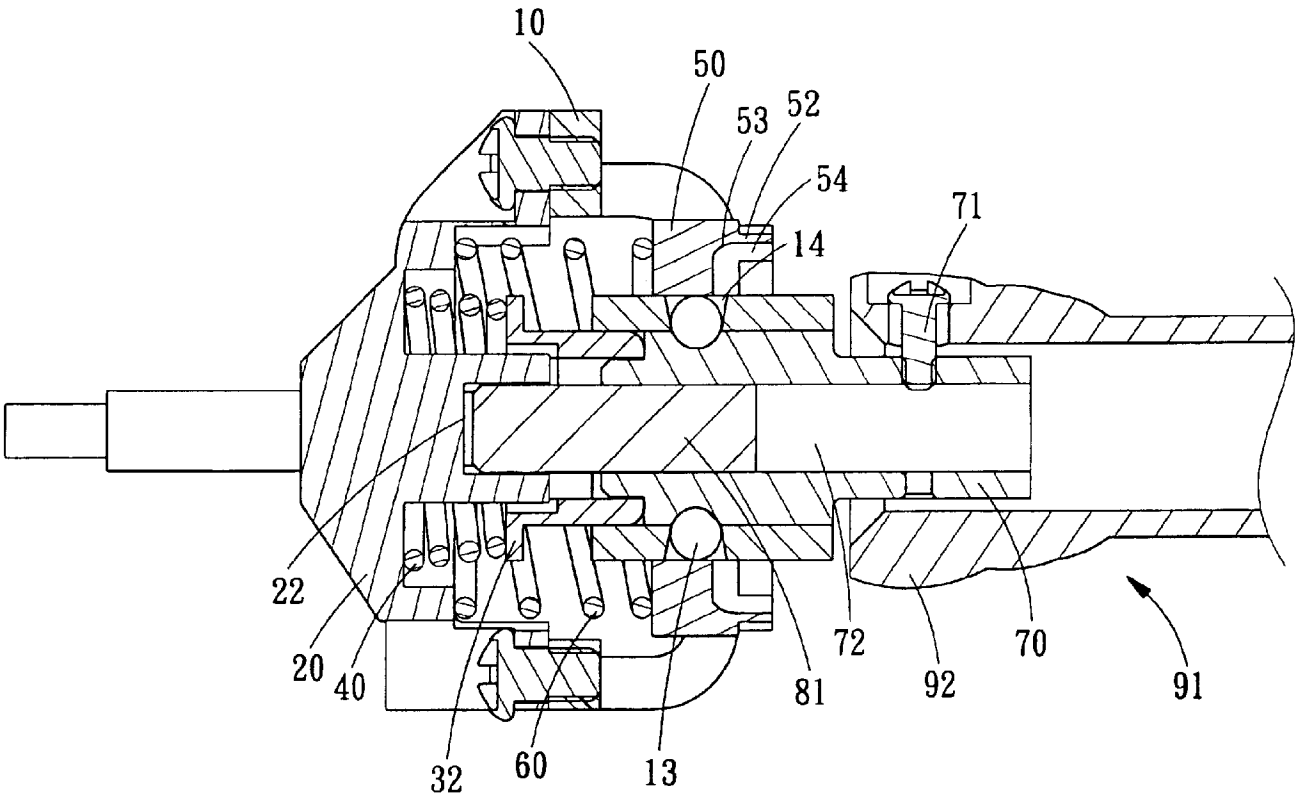
FIG. 5 is another cross sectional view of showing a quick connector for power wire, in accordance with an embodiment of the present invention, is being assembled.

In FIGS. 4 and 5, to fix the ceiling light 91 to the distribution box 90, the user should initially insert the male base 70 on the connecting end 92 of the ceiling light 91 into the passage 11 of the female base 10 (the shape of the working portion 73 corresponds to that of the passage 11). Since the flange 75 of the working portion 73 corresponds to the two protrusive pieces 31 of the sliding piece 30, the flange 75 of the male base 70 will push the two protrusive pieces 31 of the piece 30 to move backward, and thus the inner spring 40 begin to store elastic force. Until the cambered surface 33 at the front of the protrusive pieces 31 doesn't affect the rolling needle 15 anymore, the flange 75 of the female base 10 has passed the through hole 14, and the rolling needle 15 will move inward again under the pushing force of the loop 50. In this way, the rolling needle 15 can exactly move into the locating groove 76 on the working portion 73 of the male base 70, and the loop 50 will completely cover the through hole 14 (so the rolling needle 15 cannot move out). At the same time, the male cover 80 just inserts in the connecting portion 22 of the female cover 20, such that the power can be transmitted to the power wire 23 of the female cover 20 from the power wire 93 which connected to the male base 80. Through the engagement of the rolling needle 15 of the female base 10 in the locating groove 76 of the male base 70, the ceiling light 91 can be securely connected with the distribution box 90, and so as to prevent the leakage.

Referring to FIG. 6, to disassemble the ceiling light 91, the user needs to push the loop 50 with his hand, so as to compress the outer spring 60 with the loop 50 and make the rolling needle 15 slide outward via the through hole 14. At this moment, the user is able to pull the ceiling light 91 out with his another hand, the male base 70 can push the rolling needle 15 out of the through hole 14 with the arc surface of the locating groove 76, so as to make it move into the receiving groove 54 of the loop 50 again. And the sliding piece 30 is pushed again by the inner spring 40 to move forward, and thus the rolling needle 15 protrudes out again and the protrusive pieces 31 completely cover up the through hole 14 of the passage 11. Thereby, the assembly and disassembly of the present invention is easy and quick, furthermore, it can prevent electrical leakage.

Figure 8:
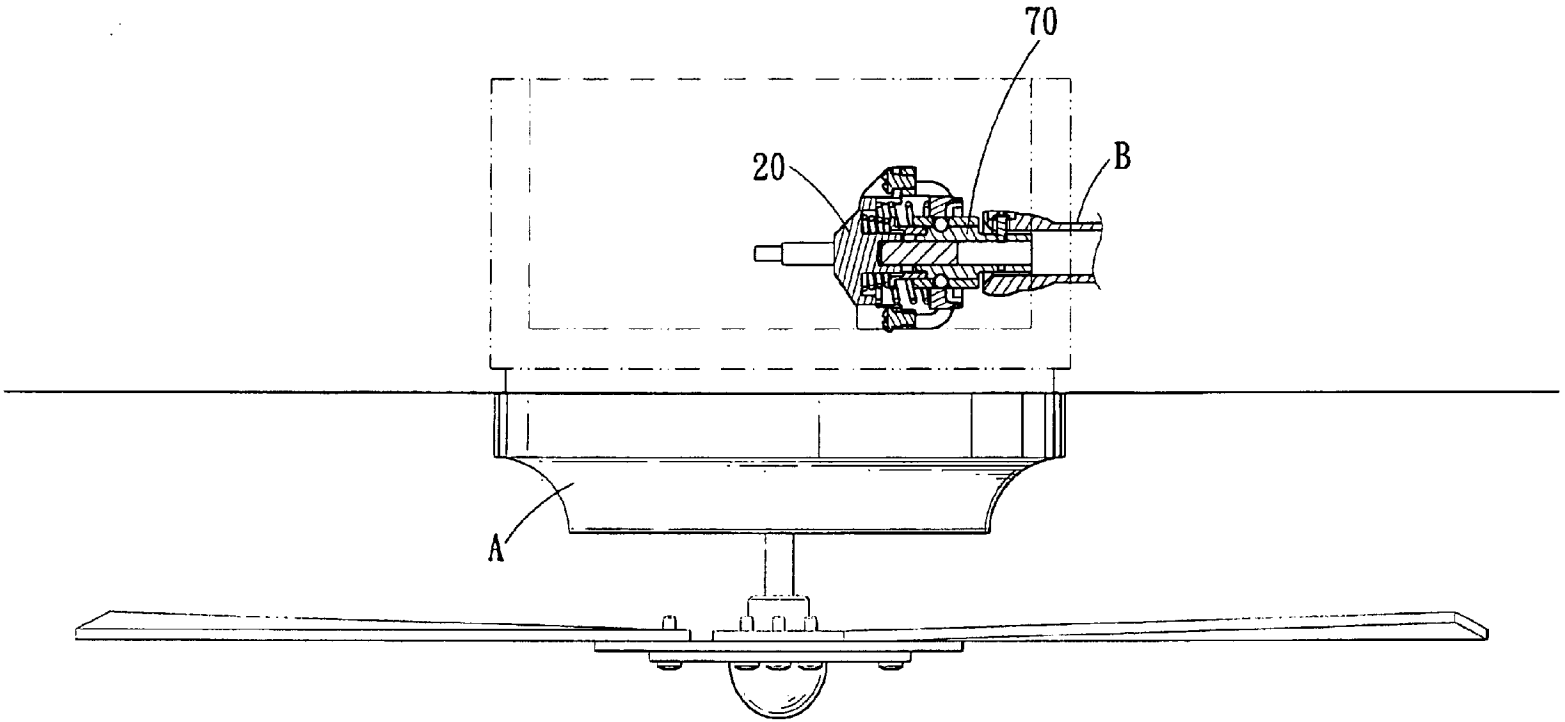
FIG. 8 is an illustrative view of a quick connector for power wire in accordance with another embodiment of the present invention.

Referring to FIG. 8, which shows a quick connector for power wire in accordance with another embodiment of the present invention. Wherein the quick connector for power wire also can be applied in the distribution box 90 above a ceiling light (A), the male 70 is provided on an end of a power wire (B) (the object to be connected) that is disposed in the wall.

While we have shown and described various embodiments in accordance with the present invention, it should be clear to those skilled in the art that further embodiments may be made without departing from the scope of the present invention.

What is claimed is:

1. A quick connector for power wire comprising: a female base, a female cover, a sliding piece, an inner spring, a loop, an outer spring, a male base and a male cover, the quick connector being disposed between a distribution box and an object to be connected;

the female base, interiorly defined with a through passage, being fixed in the distribution box, at both sides of the passage formed with sliding holes, at the position corresponding to the sliding holes being respectively formed with two through holes extending outward from inner surface of the passage, in the through holes being disposed with rolling element;

the female cover mounted on the female base, a connecting portion being formed in the female cover and employed to connect power wire;

the sliding piece, on which is provided with two protrusive pieces, in a front end of the two protrusive pieces formed with cambered surfaces, the sliding piece being movably disposed between the female base and the female cover, and the two protrusive pieces being inserted in the passage of the female base in a manner that the two protrusive pieces abutting against the inner surface of the passage, traveling path of the two protrusive pieces corresponds to the through holes of the passage;

the inner spring biased between the sliding piece and the female cover;

the loop defined at its center with a through hole, and at both sides the loop formed with protrusions, the through hole serving to receive the inner spring and the sliding piece, the protrusions to be slidably inserted in the sliding holes of the female base, at outside of an inner surface of the protrusions a cambered surface and a receiving notch being sequentially formed, the cambered surface and the receiving notch correspond to the through holes of the female base, and the receiving notch serving for the reception of rolling needle of the female base;

the outer spring biased between the loop and the female cover for the reception of the inner spring;

the male base fixed to an end of the object to be connected, on the male base corresponding to the end of the object being defined with working portion which is shaped in corresponding to the passage of the female base, from an end of the working portion inward a cambered edge, a flange and a locating groove being formed sequentially, the cambered edge and the locating groove correspond to the rolling needle of the female base, the flange corresponds to the two protrusive pieces of the sliding piece;

the male cover, at an end of which is defined an inserting portion that formed in corresponding to shape of the connecting portion of the female cover, the male cover being received in the engaging hole of the male base, such that power can be transmitted to the to-be-connected object from the female cover.

2. The quick connector for power wire as claimed in claim 1, wherein the sliding piece consists of two protrusive pieces and a ring portion, the inner spring is biased between the ring portion of the sliding piece and the female cover.

3. The quick connector for power wire as claimed in claim 1, wherein the rolling element of the female base is rolling needle.

4. The quick connector for power wire as claimed in claim 1, wherein the rolling element of the female base is rolling ball.

* * * * *